US006599257B2

(12) United States Patent
Al-Obaidi et al.

(10) Patent No.: US 6,599,257 B2
(45) Date of Patent: Jul. 29, 2003

(54) CERVICAL THERAPY DEVICE

(76) Inventors: Saud M. Al-Obaidi, P.O. Box 31470, Sulaibikhat 90805 (KW); Omar Al-Bannai, P.O. Box 240, Salmiya, 22003 (KW); Fawzi Ahmad Osta, P.O. Box 2943, Safat (KW), 13030

( * ) Notice: Subject to any disclaimer, the term of this patent is extended or adjusted under 35 U.S.C. 154(b) by 0 days.

(21) Appl. No.: 10/014,495

(22) Filed: Dec. 14, 2001

(65) Prior Publication Data

US 2003/0114780 A1 Jun. 19, 2003

(51) Int. Cl.[7] ..... A61H 1/00
(52) U.S. Cl. ..... 601/5; 601/39; 482/10
(58) Field of Search ..... 601/5, 24, 25, 601/26, 33, 39, 84, 90, 92, 93, 97, 98, 101; 602/17, 18, 32–36; 482/10, 11, 129

(56) References Cited

U.S. PATENT DOCUMENTS 5,569,175 A * 10/1996 Chitwood ..... 601/39
5,682,327 A * 10/1997 Telepko ..... 601/33
5,967,999 A * 10/1999 Hulicsko et al. ..... 602/32
5,984,836 A * 11/1999 Casali ..... 482/10
6,106,437 A * 8/2000 Brooks ..... 482/10
6,155,994 A * 12/2000 Hubbard et al. ..... 601/5
6,210,354 B1 * 4/2001 Ousdal ..... 602/36
6,503,213 B2 * 1/2003 Bonutti ..... 602/5

* cited by examiner

*Primary Examiner*—Danton D. DeMille
*Assistant Examiner*—Quang D Thanh
(74) *Attorney, Agent, or Firm*—Dennison, Schultz & Dougherty

(57) ABSTRACT

A cervical therapy device for providing continuous passive motion to the head or neck of a patient includes a patient's support such as a chair and an upwardly extending frame which extends upwardly above the chair. The frame supports a two piece neck bracket for fitting around a patient's neck. The neck bracket also includes a chin support and occipital cuff for positioning the patient's head within the bracket. The device also includes an actuator and controller for providing continuous passive motion to the head and neck of the patient. The device also includes a pair of double pivotal joint assemblies which allow a movement about two perpendicular axes with linear movement along one of the axes so that the head and neck are moved through a series of prescribed movements to relieve neck pain and/or disfunction.

11 Claims, 9 Drawing Sheets

CERVICAL THERAPY DEVICE

FIELD OF THE INVENTION

This invention relates to a cervical therapy device and more particularly to a cervical therapy device for relieving pain and dysfunction in the cervical spine.

BACKGROUND FOR THE INVENTION

The prevalence of neck pain is high, ranging between 12 to 34 percent of the normal population depending on age group. Older individuals display a higher incidence of neck pain with radiculopathies, degenerative changes, arthritis and other losses of the range of motion of the neck.

It is presently believed that the cervical fine bones are under ongoing transformation of boning structure due to excessive use and abuse of the cervical spine during daily activities, environmental stresses, sports and leisure time activities. Such stress leads to degenerative changes in the vertebral bodies, plate and intervertebral joints as well as zygapophysical joints. In addition, the cervical spine is a relatively unstable part of the spinal column, and equilibrium can easily be disturbed by sudden movements, aggressive approaches, minor trauma and even overnight sleeping postures.

The management and care of neck problems is difficult and requires a profound knowledge in functional anatomy and biomechanics. Notwithstanding a profound knowledge of such subjects, physicians and therapists continue to witness failure in treating neck patients. Such failures may be due to the fact that many clinicians do not always recognize their limits or deceive themselves with respect to their ability and choice of therapeutic approaches.

One approach for treating neck problems is disclosed in the U.S. Pat. No. 5,569,175 of Chitwood for a Pivotal Cervical Traction/Stretch and Neck Curve Support Device. That device comprises a base portion having an upper inclined surface for supporting a patient's upper body. It also includes a pivotal mounting mechanism for pivotally and rotationally mounting the platform in a manner which allows rotation about any one or all of an x-axis, y-axis and a z-axis. The device also includes a head portion and a mechanism for incrementally moving the head portion away from the inclined surface.

A number of exercises for the cervical spinal area have also been developed and implemented to solve neck pain and dysfunction. Such exercises are designed to restore the intervertebral and facet motion and at the same time to relieve pain. It is presently believed that a mechanical passive movement device with longer time durations and a higher number of repetitions of such exercises in a single session will result in a more effective treatment for neck pain and dysfunction. It is also believed that the mechanical passive movement will be particularly helpful to those patient's who are physically limited in a number of repetitions due to fatigue, lack of strength or pain.

Continuous passive motion orthosis devices are known, as for example disclosed in a U.S. Pat. of Telepko, No. 5,682,327 for a universal controller for continuous passive motion devices. That patent is incorporated herein in its entirety by reference. As disclosed therein, continuous passive motion orthosis devices provide an important rehabilitative treatment used by doctors and therapists for treatment of injuries. Such devices are typically motor driven and are designed to exercise a particular joint by repeatedly extending and flexing the joint.

It is presently believed that there is a need for a cervical therapy device in accordance with the present invention. Such devices will provide continuous passive motion for relieving pain and dysfunction in the cervical spine.

One advantage of the cervical therapy devices in accordance with the present invention resides in the capability of applying continuous motion to the cervical spine in a consistent or repetitive manner. Such repetitions may include full movement as programmed by a therapists and overcomes a likelihood of a patient following an easier or less complete movement.

Another advantage of the present invention relates to the fact that it can be operated at different speeds, different ranges of motions, different forces and programmed for particular exercises. A further advantage of the devices is that they can be programmed to vary the angular position, velocity and torque associated with neck movement about the neck axis of flexion/extension, lateral flexion and axial rotation of the neck. In addition, the devices in accordance with the present invention are operable by a trained technician following a physician or therapists instructions.

Further the cervical therapy devices disclosed herein are believed to be applicable to basic neck exercises including protraction, retraction, extension, flexion, rotation and axial traction and combined neck exercises including retraction and extension, retraction and flexion, retraction and rotation, traction and retraction, sustained natural apophysical glide (SNAGs) and reverse sustained natural apophysical glide (RSNAGs).

Nevertheless, it should be recognized that there are certain indications which indicate that the cervical therapy device in accordance with the present invention should not be used. For example, in those cases involving recent cervical fracture, dislocation, muscle and ligament ruptures, cervical joint instability, vascular abnormalities, advanced diabetes, active inflammatory diseases, malignant tumors of the cervical spine, central nervous system involvement, infectious diseases, severe bone weakening diseases, psychogenic pain, psychiatric illness and history of fainting and seizures.

BRIEF SUMMARY OF THE INVENTION

In essence, the present invention contemplates a cervical therapy device for relieving cervical pain and dysfunction. The device includes patient support means such as a chair for supporting a patient in a seated but upright position. A suitable backrest is preferably provided with a restraint to maintain the upper torso in a fixed upright position. The chair also preferably includes adjusting means for elevating a seat portion so that the feet rest comfortably on the floor and/or a foot support and an adjustable back support. Such features ensure that a patient is sitting in a correct but comfortable position. The back support may include an adjustable lumbar support. The cervical therapy device also includes an upwardly extending frame which extends upwardly above the patient support means and a neck bracket which is adapted to fit around a patient's neck. The neck bracket includes means for supporting a patient's chin and means for supporting a patient's occipital cuff at the back of a patient's head. The chin support and support for the occipital cuff positions a patient's head within the neck bracket for continuous passive motion. The cervical therapy device also includes control means or a controller and an actuator which is connected to the neck bracket for providing continuous passive motion to the head and/or neck in a manner which is programmed into the controller. The device also includes a pair of double pivotal joint assemblies which allow rotational movement about two perpendicular axes with linear movement along one of the axis disposed between the bracket and the actuator. In this way the head and neck are moved through a series of prescribed movements to relieve neck pain and/or dysfunction.

The invention will now be described in connection with the following schematic illustrations wherein like reference numerals have been used to identify like parts.

DESCRIPTION OF THE PREFERRED EMBODIMENTS OF THE INVENTION

A cervical therapy device (C-Rx) in accordance with the present invention is illustrated in the following FIGS. 1–8.

However, it should be recognized that all patient's should be screened by a qualified physician or physical therapist to ensure that mechanical therapy is appropriate for the patient. In addition, pain and symptom intensities, location, ranges of movements as well as pain occurring during movement should be monitored at all times during therapy.

Figure 1:
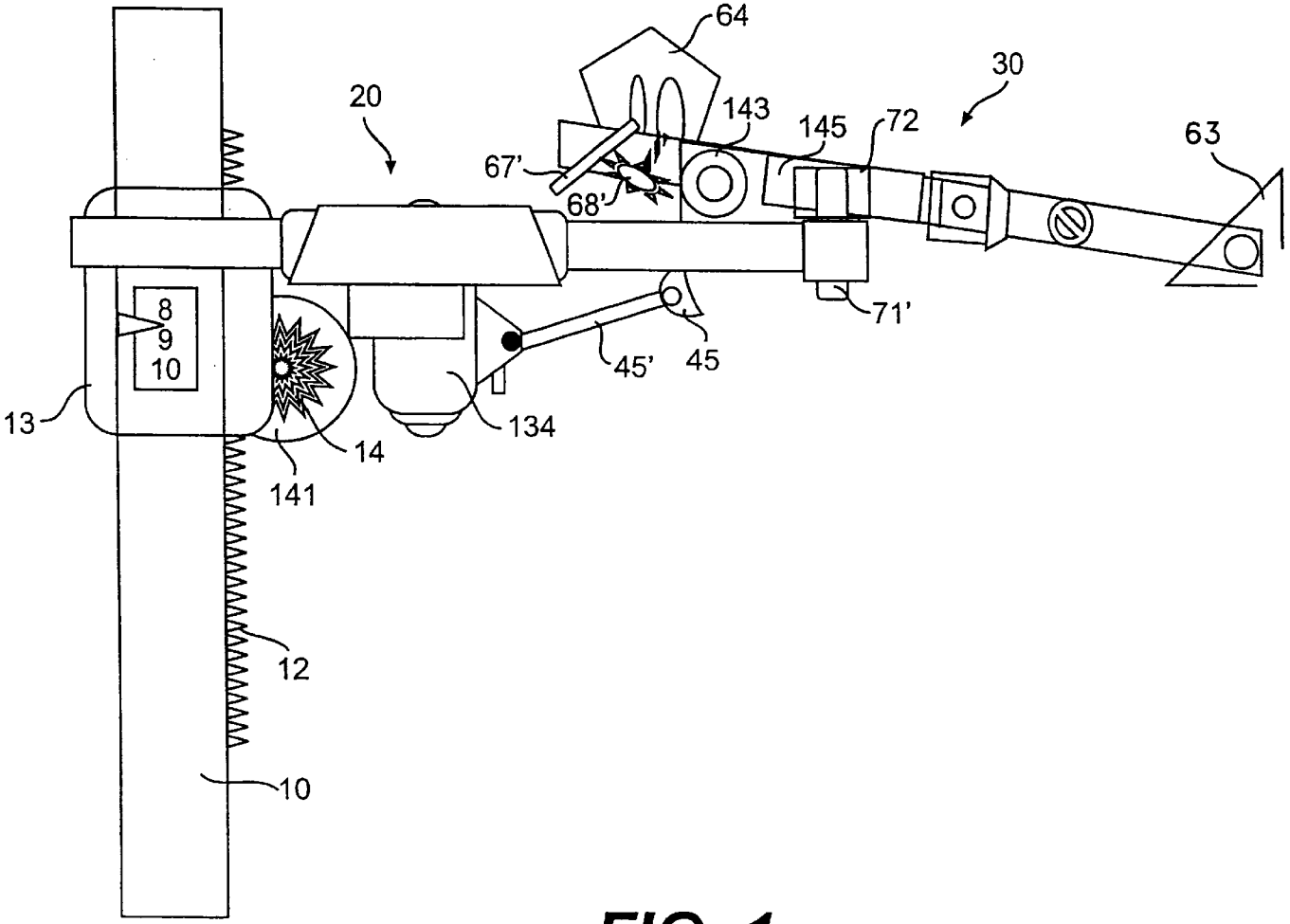
FIG. 1 is a side elevational view of a frame member, carrier and neck bracket for a cervical therapy device in accordance with the present invention.

As illustrated in FIGS. 1 and 2 the cervical therapy device according to the present invention includes a generally vertical frame 10, carrier 20 and neck bracket 30. The vertical frame may have a generally square or other cross section and includes a rack 12 that is a bar with teeth on one side thereof for engagement with a pinion or gear 14. A slidable housing 13 is adapted to encircle the frame 10 and to move up and down along the frame 10 in response to the rotation of the gear 14 to position the carrier 20 at an appropriate height to accommodate a patient. In this way the neck bracket 30 can be accurately positioned for a particular patient. Once positioned, the carrier 20 may be temporarily fixed in place on the frame 10 by any conventional locking means (not shown). However, after positioning the patient and neck bracket, a motor 141 may be engaged to rotate the gear 14 to apply traction and/or relaxation to the patient. A motor 143 and gearbox 145 are provided for rotating the neck bracket 30 back (retraction) and forth (protraction) about a first axis.

An optional segmental blocker which includes a small rubber cuff 45 and shaft 45' allows for selective regional cervical blocking to promote sustained natural apophysical glide (SNAGs) and reverse natural apophysical glide (RSNAGs). The segmental blocker requires no motor or computer program. It is the small shaft 45' oriented at about 45° from horizontal and can be manually adjusted to appropriate cervical level before starting the therapy session. It can also be readily removed without any harm to the C-Rx device.

Figure 2A:
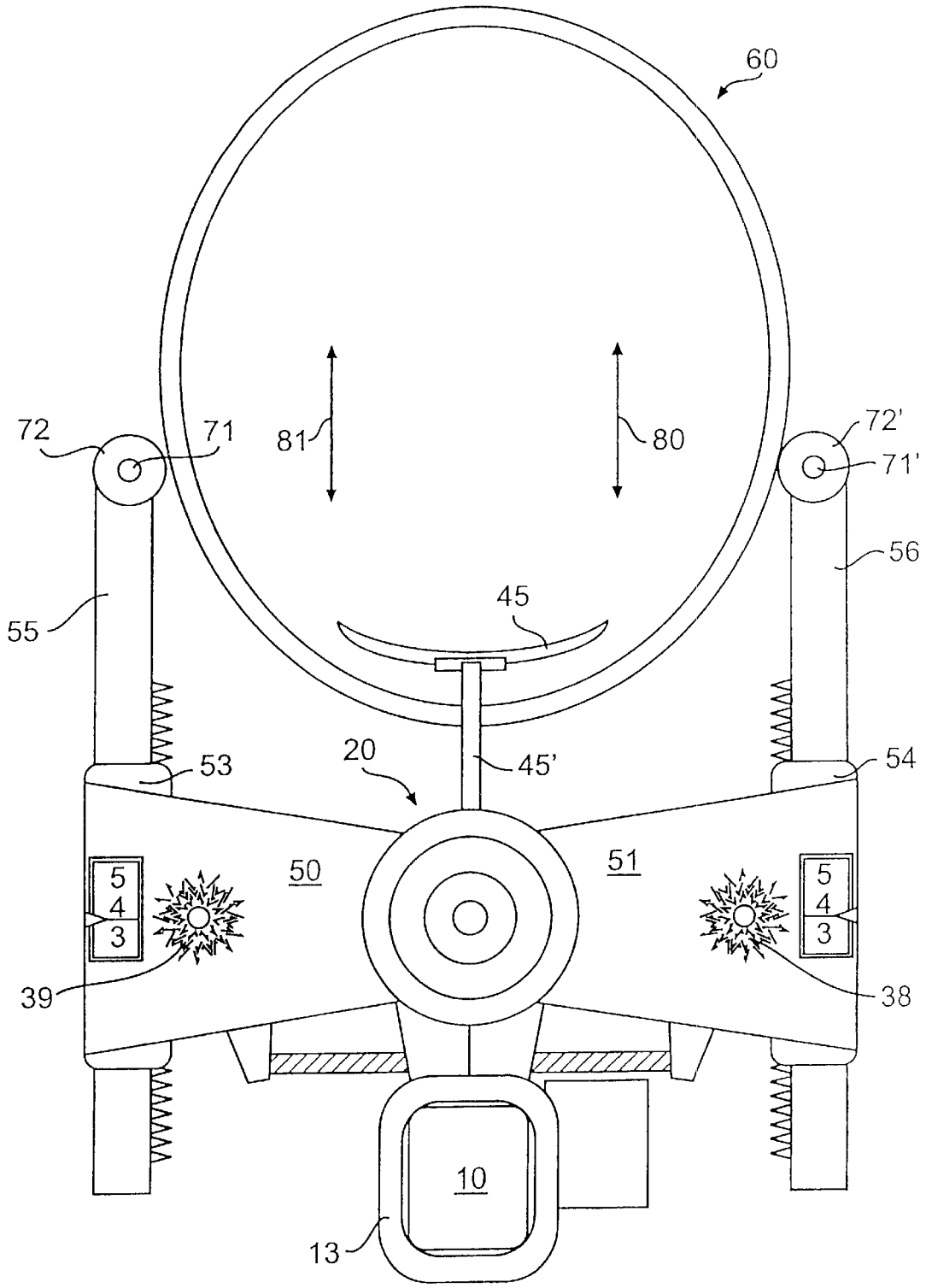
FIG. 2A is a top or plan view of the frame and movable support member shown in FIG. 1.
Figure 2B:
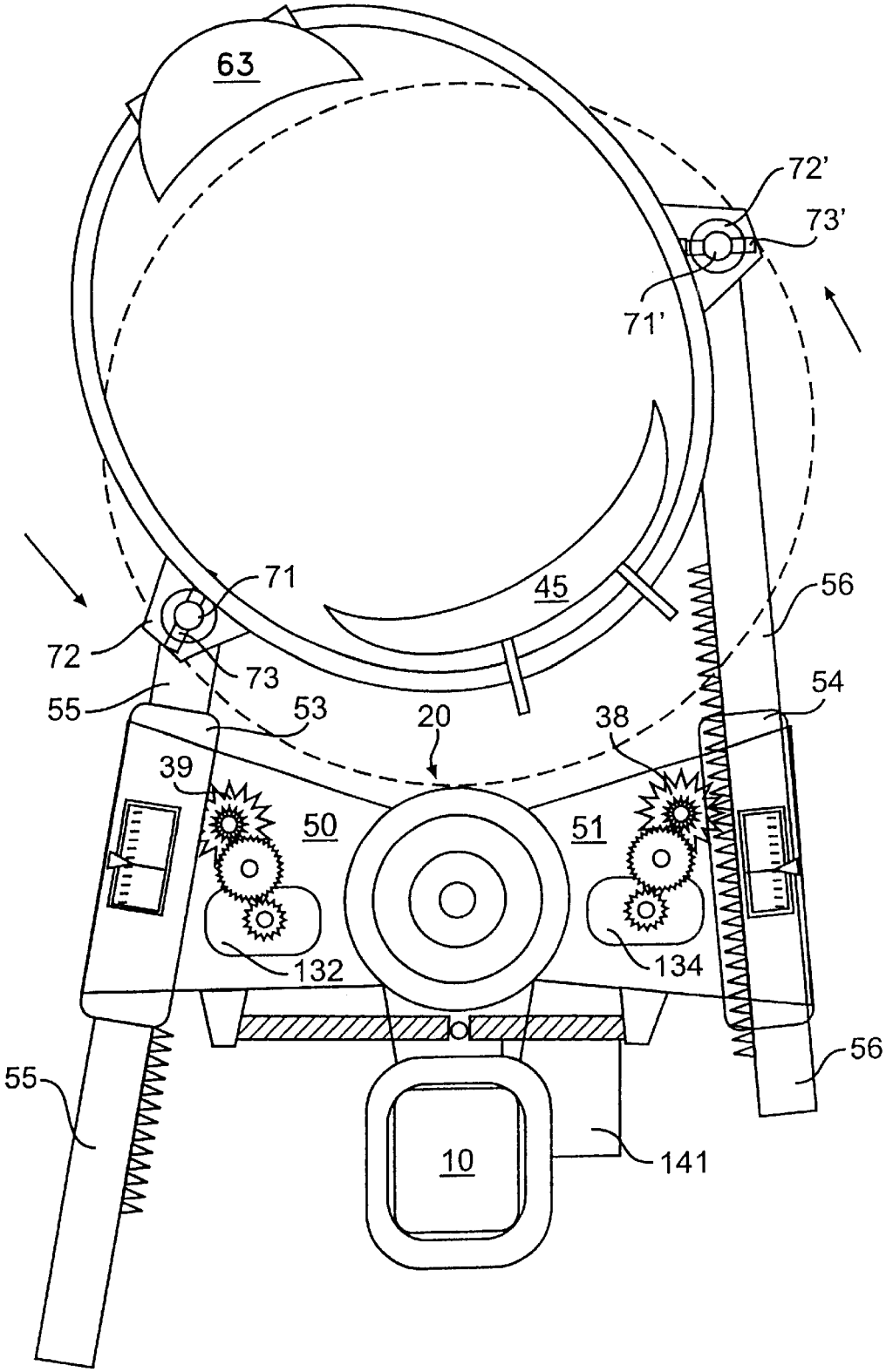
FIG. 2B is a schematic plan view of the frame and movable support shown in FIG. 2A, but with the movable support rotated to a second positions.

As illustrated more clearly in FIGS. 2A and 2B, the carrier 20 includes a pair of cross members or wings 50 and 51 each of which include an outer housing 53 and 54, respectively. Each of the housing 53 and 54 include a hollow passage for receiving shafts 55 and 56. The shafts 55 and 56 are moved in opposite directions by gears 38 and 39 in response to the rotational movement of the second and third motors 132 and 134 (FIG. 2B) to turn a patient's head to the left and right in a generally horizontal plane. Since the outer support element 60 is not circular, the distance between the element 60 and shafts 55 and 56 varies slightly. Therefore, the rotatable elements 72 and 72' move laterally as for example along the horizontal shafts 73, 73' (as shown in FIGS. 2A and 2B).

When the gears 38 and 39 are rotated in the same direction, the outer support element 60 is moved in a forward and backward direction in a generally horizontal plane for protraction and retraction as indicated by the arrows 80 and 81.

Figure 3A:
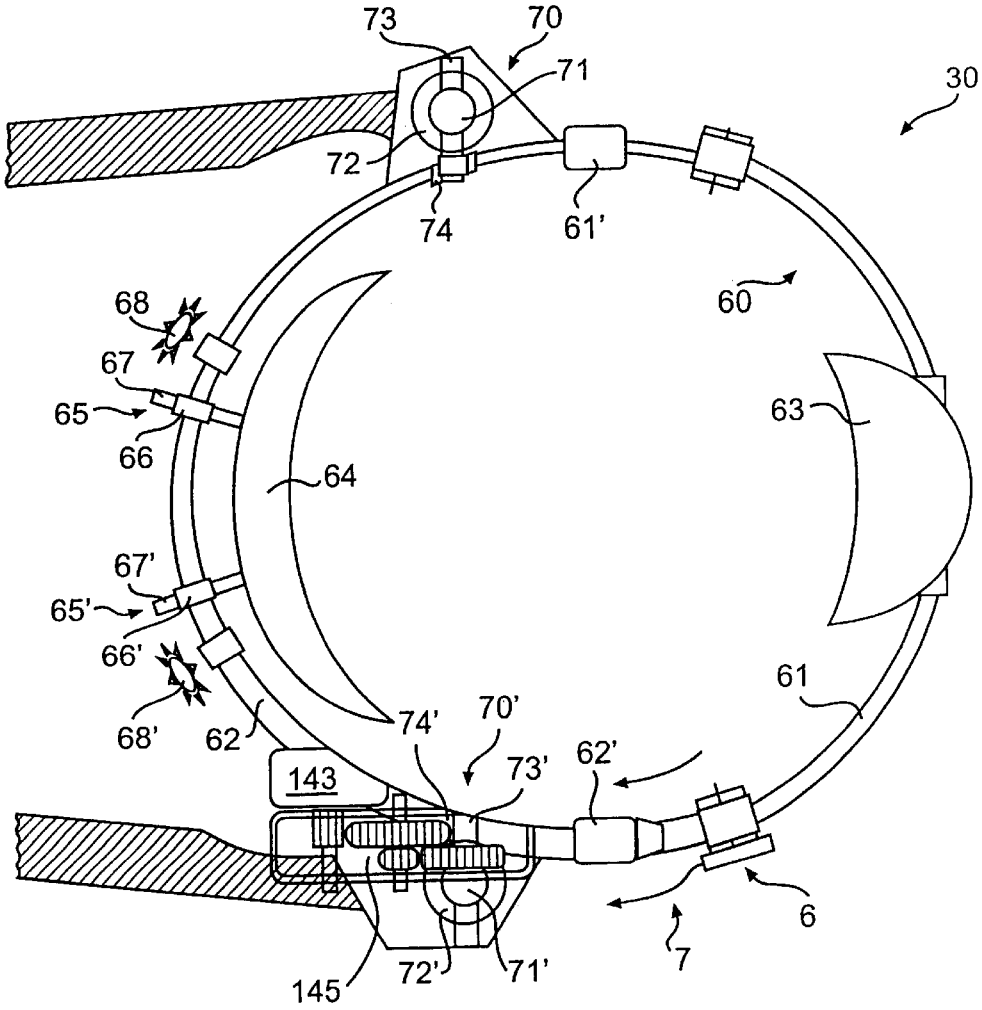
FIG. 3A is a plan view of the neck bracket shown in FIG. 1.
Figure 3B:
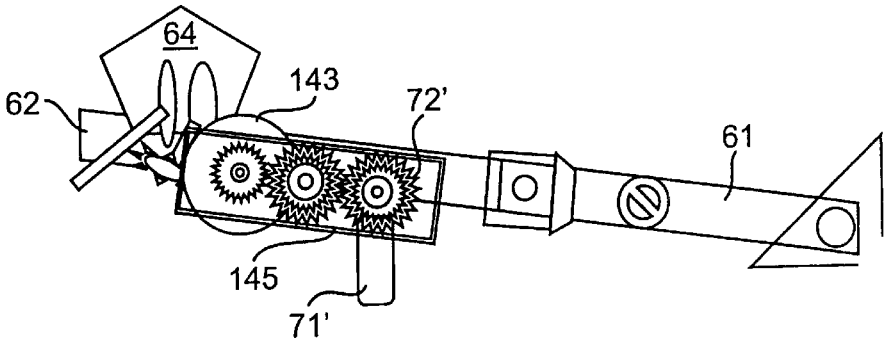
FIG. 3B is a side view of the neck bracket shown in FIG. 3A.

FIG. 3 illustrates the neck bracket 30 which includes a generally ring-shaped outer support element 60 which is preferably made up of two segments 61 and 62 which are joined together by joint attachment 61' and 62'. A chin cuff 63 is positioned on a front portion of the support 60 and adapted to receive a patient's chin therein. The cuff 63 may be rotatably mounted on the forward segment 61 of the support 60 and is constructed to accommodate a patient's chin and in combination with an occipital cuff 64 positions a patient's head within the support element 60. A sensor 6 is provided for measuring the weight of a patient's head. The signal passes via cable 7 to any suitable means for processing the information.

The occipital cuff 64 for supporting a patient's occipital region by a rubber cuff at the back of a patient's head, is mounted on two slide assemblies 65 and 65' which include a pair of housing 66 and 66' having a hollow passage and a pair of pins 67 and 67' which are fixed to the occipital cuff. A pair of adjusting screws 68 and 68' provides a firm grip on the occipital region.

An important feature of the present invention resides in a pair of double pivotal joint assemblies 70, 70' which provide rotation about two perpendicular axes and linear movement along one of the axes. The pair of joint assembly 70, 70' are disposed on opposite sides of the neck bracket 30 and between the chin cuff 63 and occipital cuff 64 but nearer to the occipital cuff then to the chin cuff 63.

The joint assemblies 70, 70' include vertical shafts 71, 71', and bearing rotatable elements 72, 72' which are free to rotate with respect to the shafts 71, 71' respectively, to turn the bracket 30. In this manner a patient's head is turned from one side to neutral then to the side. Rotation is possible for 35° to 40° of neck rotation.

The joint assemblies 70, 70' also include a pair of horizontal shafts 73, 73' and bearing elements 74, 74' which allow rotational movement about the shaft 73, 73'. This rotational movement allows the bracket 30 to tilt a patient's head in a flexion and extension respectively. The horizontal shafts 73, 73' also allow linear movement in the horizontal plane to accommodate the displacement of the bracket 30 as it is turned from side to side in a horizontal plane.

Figure 4:
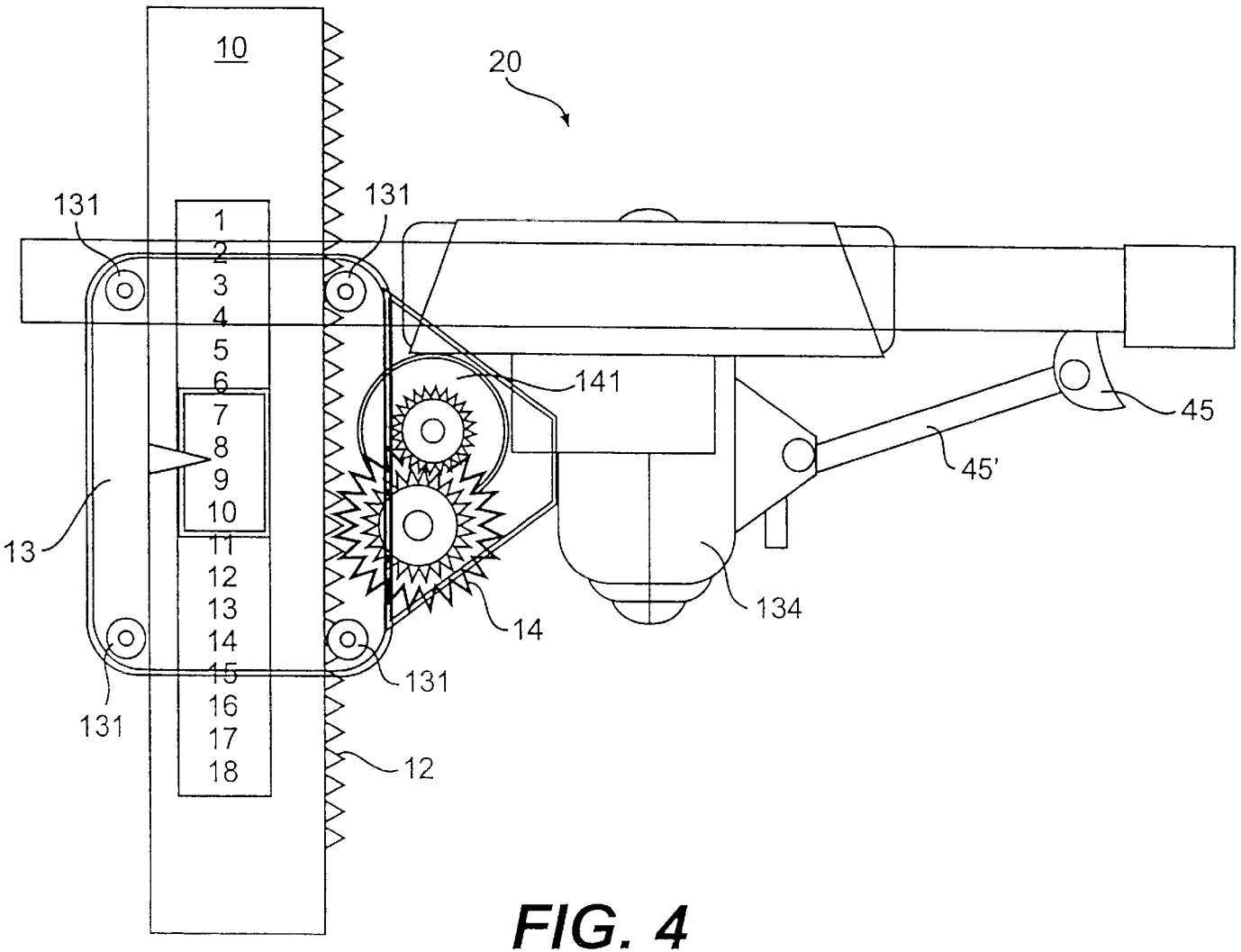
FIG. 4 is a schematic illustration of a motor and gear assembly as incorporated in a device in accordance with the present invention.

FIG. 4 is a schematic illustration of a portion of a cervical therapy device which is generally similar to the one shown in FIG. 1. The mechanism for moving the neck bracket 30 up or down includes a motor 141 which is offset from gear 14 and moves the carrier 20 by means of a rack 12. The housing 13 moves along the vertical frame on bearings 131 which provide a smooth transition of the neck bracket 30.

Figure 5:
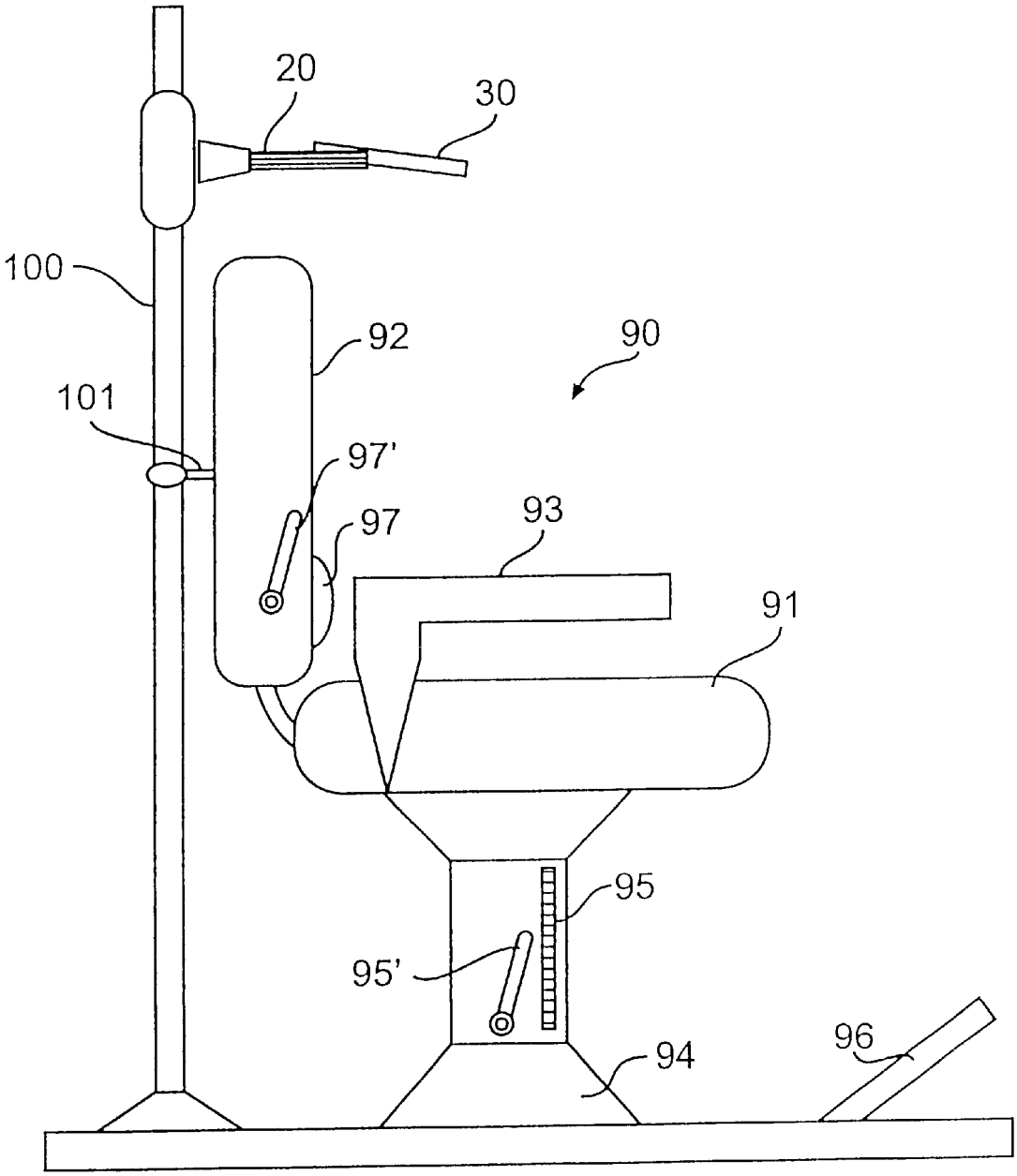
FIG. 5 is a side elevational view of the cervical therapy device in accordance with one embodiment of the invention.
Figure 6:
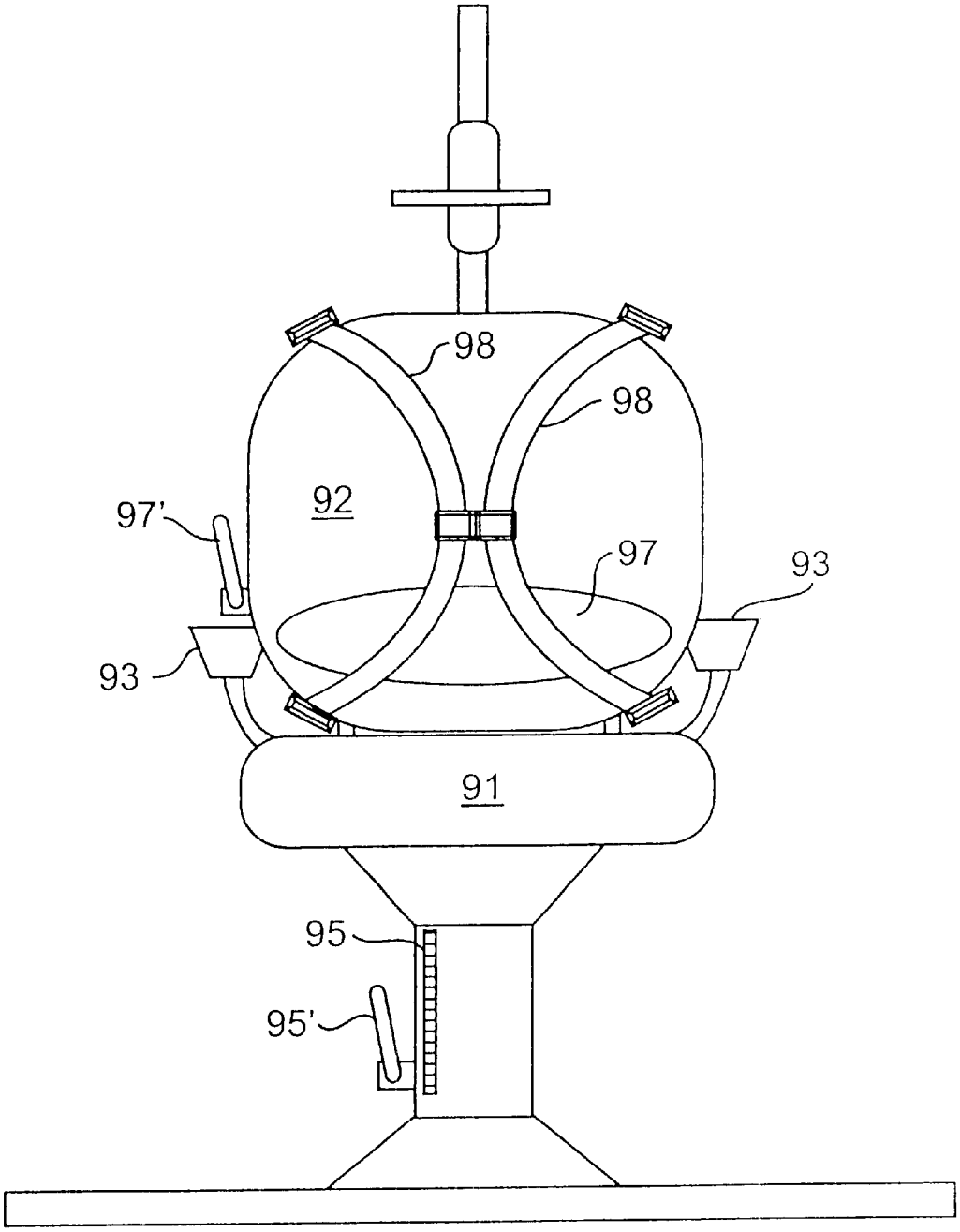
FIG. 6 is a front view of the chair used with the cervical therapy device shown in FIG. 4 and which shows the strapping belts, seat and seat elevation means.

A patient's support system or chair 90 for supporting a patient in a seated position and an upwardly extending or vertical frame 100 is shown in FIGS. 5 and 6. As shown the vertical frame 100 extends upwardly behind the chair 90 to position and support the carrier 20 and neck bracket 30 with respect to a patient's neck.

The chair 20 may be of a conventional design with a high back supporting the upper third of the thoracic region. For example, it will typically include a seat 91 separate backrest 92 and armrest 93. The chair 90 should also include a stable base 94, an adjustment mechanism 95, 95' for raising and lowering the seat 91 so that a patient's feet rest comfortably on the floor or on a footrest 96. The backrest 92 is fixed to the frame 100 by bracket 101 and is designed to position the upper body in a straight, erect or upright position. A lumbar support 97 is also provided for patient positioning and comfort and may be adjusted by handle 97'. As shown in FIG. 6, straps 98 are provided to hold the patient in the proper position during treatment.

Figure 7:
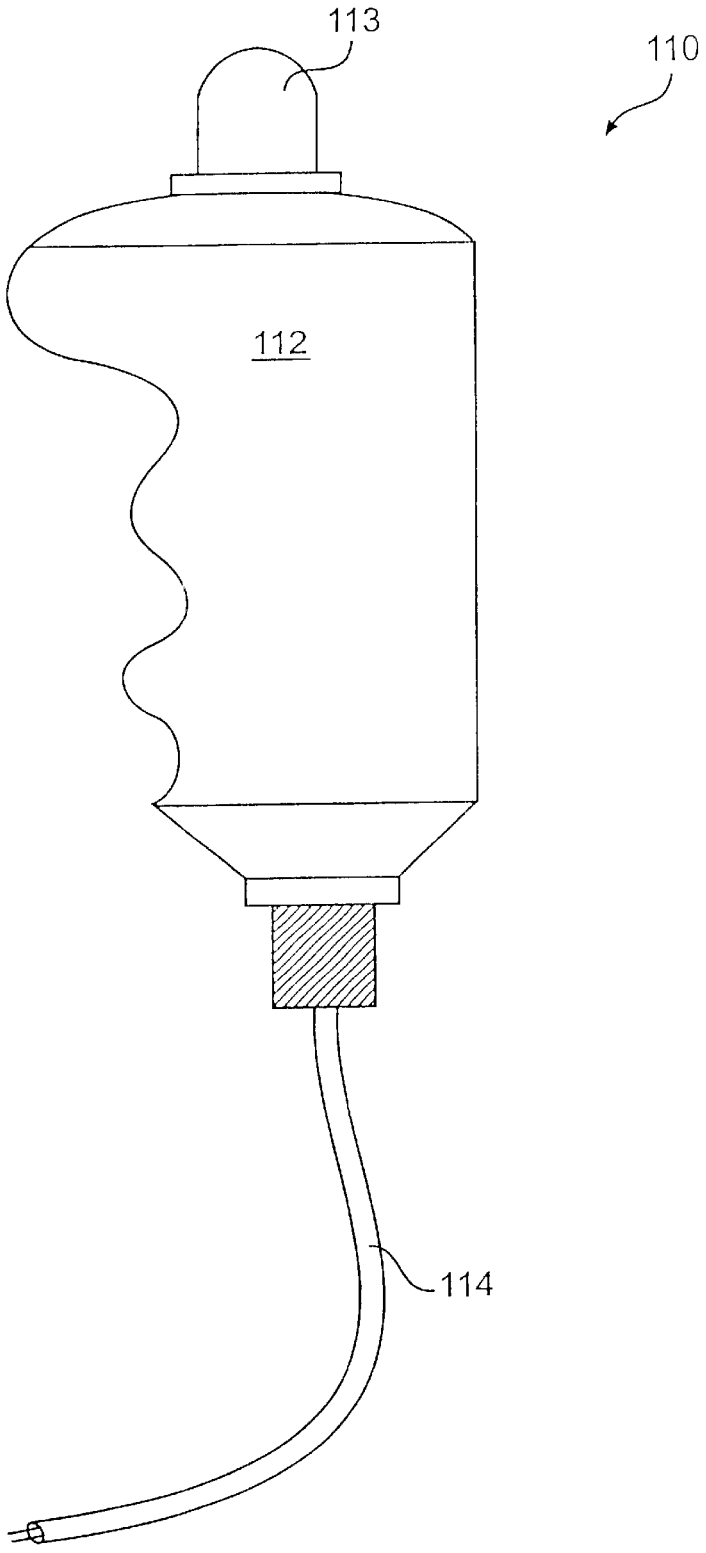
FIG. 7 is a side elevational view of an emergency shut-off switch which is incorporated in one embodiment of the invention; and, FIG. 8 is a block diagram which illustrates an interface between a computer controller and actuator for a cervical therapy device in accordance with the present invention.

A handheld emergency shut-off device 110 is shown in FIG. 7. As illustrated, the device 110 includes a hand grip 112, an emergency stop button 113 and an electrical cord 114 for sending a signal to stop a treatment if a patient feels pain or concern.

A universal controller such as the one disclosed in the aforementioned U.S. Pat. No. 5,682,327 of Telepko may be incorporated for controlling the cervical therapy device in accordance with the present invention. Such devices typically include a control panel and a series of keys to provide input parameters which define the limits and modes or operations in treating neck pain and dysfunction. The controller includes a microprocessor which processes the input parameters and controls the operation of the device in a conventional manner as will be well understood by a person of ordinary skill in the art.

Figure 8:
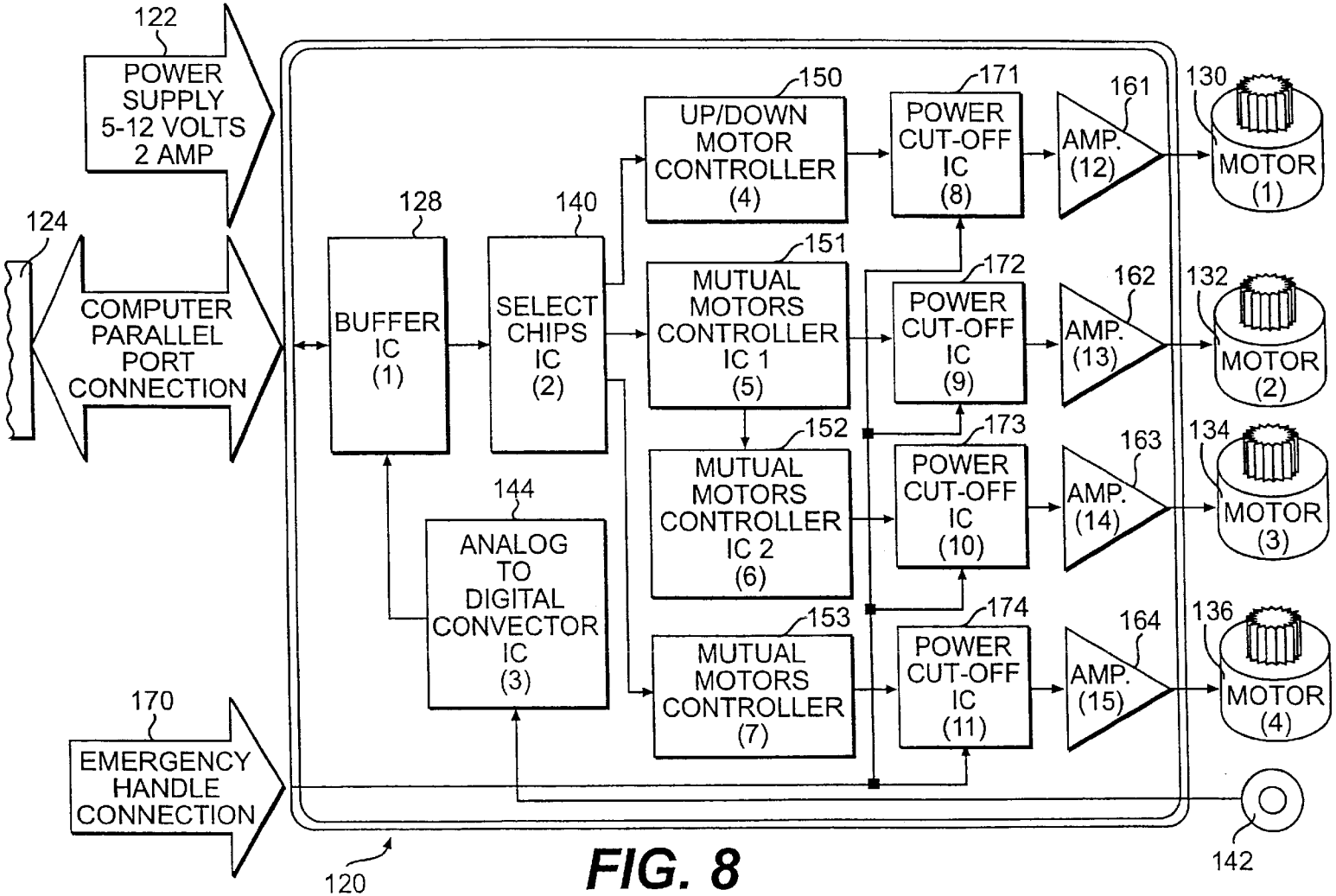

FIG. 8 is a block diagram which illustrates an interface between a universal controller or computer and a mechanical portion of the cervical therapy device in accordance with the present invention. As shown in FIG. 8, an interface 120 is connected to a computer 124 as for example disclosed in the Telepke Patent No. 5,682,327 by means of a computer parallel port connection 126.

The interface 120 also includes a conventional buffer 128 between the computer 124 and four motors 130, 132, 134 and 136 (in FIG. 8) to protect the computer from any voltage variations caused by the motors. The buffer 128 also regulates the 5 volt signal.

A select chip 140 or integrated circuit electronically selects which of the motors 130, 132, 134 and 136 is to be acted upon in accordance with the programmed instructions from the computer 124. The device also includes a weight sensor 6 which monitors the mechanical traction forces applied to the neck. This is done by converting a mechanical signal to an electrical signal by a potentiometer resistor and to an analog to digital converter center 144 then to buffer 128.

The selector chip 140 provides a signal to one or more up/down motor controllers 150, 151, 152 and 153 to govern actuation and direction of rotation of each of the motors. A series of amplifiers 161, 162, 163 and 164 are provided in the circuit between the controllers 150, 151, 152, 153 and motors 130, 132, 134 and 136 in a conventional manner.

The interface 120 also includes an emergency handle connection 170 and emergency power cut-off switches 171, 172, 173 and 174 for stopping a treatment in the event of pain or discomfort.

While the invention has been described in connection with its preferred embodiments, it should be recognized and understood that changes and modifications may be made therein without departing from the scope of the appended claims.

What is claimed is:

1. A cervical therapy device for relieving cervical pain and dysfunction, said device comprising patient support means for supporting a patient in a seated position, and an upwardly extending frame extending upwardly above said patient support means, a neck bracket adapted to fit around a patient's neck and to support a patient's head, said neck bracket including means for supporting a patient's chin and means for supporting a patient's occipital cuff at the back of the patient's head for positioning the patient's head within said neck bracket, control means and an actuator operably connected to said neck bracket under the control of said control means for moving said neck bracket through a series of prescribed movements to thereby move a patient's head through the prescribed movements, and a pair of double pivotal joint assemblies disposed between said neck bracket and said actuator, each assembly allowing rotation about two perpendicular axes with linear movement along one of said axes.

2. A cervical therapy device according to claim 1 which includes means for positioning said neck bracket along a vertical axis to thereby accommodate patients of different heights.

3. A cervical therapy device according to claim 2 which includes first means for moving the neck bracket up and down along a vertical axis to produce cervical traction.

4. A cervical therapy device according to claim 3 which includes second and third means for providing protraction/retraction and left and right rotations.

5. A cervical therapy device according to claim 4 which includes a fourth means for providing flexion and extension exercises to the cervical spine.

6. A cervical therapy device according to claim 5 in which said first means for moving said neck bracket is an electrical motor.

7. A cervical therapy device according to claim 6 in which said second and third means for moving said neck bracket are electric motors.

8. A cervical therapy device according to claim 7 which includes patient operated stop means for enabling a patient to stop the therapy.

9. A cervical therapy device according to claim 2 in which said neck bracket includes a generally circular structure extending around the head of a patient and adjustment means for positioning a patient's head between said means for supporting a patient's chin and said means for supporting a patient's occipital cuff.

10. A cervical therapy device according to claim 9 which includes a rotatable support for said means for supporting a patient's chin.

11. A cervical therapy device for relieving cervical pain and dysfunction, said device comprising a chair including a seat support, a back support, means for adjusting the height of the seat support and separate means for adjusting the back support whereby said chair can accommodate patients of different heights and proportions, said chair also includes patient restraint means for maintaining the patient in a seated but upright position; a vertically extending frame extending upwardly above said chair, a neck bracket including a generally circular support member adapted to fit around a patient's head, a chin support and occipital cuff support disposed on said generally circular support member for positioning the patient's head within said neck bracket and neck bracket adjustment means for raising and lowering said neck bracket on said vertical frame; control means and actuator controlled by said control means and operatively connected to said neck bracket for moving said neck bracket through a series of prescribed movements to thereby move a patient's head through the prescribed movement and wherein said device includes a first motor for moving the neck bracket up and down along the first vertical axes to provide cervical traction, second and third motors for providing protraction/retraction and left and right motion and a fourth motor for providing flexion and extension exercises for the cervical spine and a pair of double pivotal joint assemblies disposed between said neck bracket and said actuator, each assembly deleted allowing rotation about two perpendicular axes with linear movement along one of said axis.

* * * * *